US006138584A

United States Patent [19]

Waite

[11] Patent Number: 6,138,584

[45] Date of Patent: Oct. 31, 2000

[54] SHELVING SYSTEM

[76] Inventor: Elodie Ann Waite, P.O Box 4203, Goring on Thames, Reading RG8 0YH, United Kingdom

[21] Appl. No.: 09/359,917

[22] Filed: Jul. 26, 1999

[30] Foreign Application Priority Data

Mar. 19, 1999 [GB] United Kingdom ..... 9906428

[51] Int. Cl.[7] ..... A47B 57/00

[52] U.S. Cl. ..... 108/108; 211/187; 248/250

[58] Field of Search ..... 108/106, 107, 108/108, 110, 147.11, 147.17; 211/187, 90.01; 248/250, 240.3

[56] References Cited

U.S. PATENT DOCUMENTS

| | | | |
|---|---|---|---|
| 1,535,741 | 4/1925 | Snodgrass et al. | 248/250 X |
| 1,702,937 | 2/1929 | Friedemann | 248/250 X |
| 3,966,159 | 6/1976 | Brown | 248/250 |
| 4,010,697 | 3/1977 | Einhorn . | |
| 4,361,099 | 11/1982 | Kokenge et al. | 108/108 X |
| 4,533,104 | 8/1985 | Bell | 108/108 X |
| 4,666,117 | 5/1987 | Taft . | |
| 4,732,358 | 3/1988 | Hughes et al. | 211/90.01 X |
| 4,736,918 | 4/1988 | Bessinger . | |
| 5,575,444 | 11/1996 | Otema | 108/108 X |
| 5,794,902 | 8/1998 | Henry et al. . | |

FOREIGN PATENT DOCUMENTS

| | | |
|---|---|---|
| 0 055 861 | 7/1982 | European Pat. Off. . |
| 599360 | 3/1948 | United Kingdom . |
| 618669 | 2/1949 | United Kingdom . |
| 2 194 134 | 3/1988 | United Kingdom . |
| WO96/35358 | 11/1998 | WIPO . |

*Primary Examiner*—Janet M. Wilkens
*Attorney, Agent, or Firm*—Larson & Taylor, PLC

[57] ABSTRACT

A shelf support includes a support body having a mounting device for mounting the support on an upright component. A support surface supports a shelf. The support has a retaining element which is pivotably connected to the support body for movement into and out of an engagement position in which, in use, the retaining element engages an upper surface of a shelf supported by the support surface, thereby retaining the shelf on the support surface. The retaining element enables a shelf to be held firmly in place without the need for fixing screws, and without hindering the fitting and dismantling of the shelf support to the upright component.

11 Claims, 3 Drawing Sheets

SHELVING SYSTEM

FIELD OF THE INVENTION

The present invention relates to a shelf support having a retaining element for holding a shelf in place on the shelf support, for example in a spur shelving system.

BACKGROUND TO THE INVENTION

FIG. 1 shows a shelving structure according to the prior art. Upright components or tracks 1, which may be fixed to a wall or cupboard, have a plurality of slots 3. The slots 3 enable shelf support brackets 5 to be placed at varying heights along the tracks 1, thus allowing a shelf 7 to be erected at any desired height. In order to hold the shelf 7 in place, screws 9 are inserted through holes 11 in the shelf support brackets 5, and screwed into the shelf 7.

The need for such fixing screws 9 has the disadvantage that it deviates from the general desire to have a shelving structure that may be easily assembled, and which may be easily altered thereafter.

For example, if the height of a shelf 7 needs to be changed in the structure according to FIG. 1, the shelf 7 must first be removed from the shelf support brackets 5, which in turn requires removal of the screws 9. This is necessary because the presence of the shelf 7 prevents the shelf support brackets 5 from being tilted upwards, which is necessary to remove them from their respective slots 3.

SUMMARY OF THE INVENTION

According to a first aspect of the present invention, there is provided a shelf support comprising a support body having mounting means for mounting the support on an upright component, and having a support surface for supporting a shelf, the support having a retaining element which is pivotably connected to the support body for movement into and out of an engagement position in which, in use, the retaining element engages an upper surface of a shelf supported by the support surface, thereby to retain the shelf on the support surface.

Preferably, the retaining element is restrained from pivoting when the shelf support is engaged with the upright component.

Preferably, the mounting means extends from a mounting surface which, in use, engages the upright component.

Preferably, the retaining element has a carrier portion, which is pivotably connected to the support, is and an engaging portion which is carried by the carrier portion.

Preferably, movement of the carrier portion away from the engagement position causes a part of the carrier portion to project from the support body beyond the mounting surface, whereby, in use, the upright component provides a stop to retain the retaining element in the engagement position.

Preferably, the carrier portion extends across the plane of the support surface, the engaging portion being spaced from the support surface on the side of the support surface away from the support body.

Preferably, the engaging portion, when in the engagement position, is parallel to the plane of the support surface.

Preferably, the axis of the pivotable connection passes through the support body at a position spaced away from the support surface.

Preferably, the carrier portion has a mounting flange provided with a hole receiving a pivot pin forming the pivotable connection.

According to a second aspect of the invention, there is provided a shelving structure having a shelf support according to the first aspect of the invention.

BRIEF DESCRIPTION OF THE DRAWINGS

For a better understanding of the present invention, and to show more clearly how it may be carried into effect, reference will now be made, by way of example, to the accompanying drawings, in which.

DETAILED DESCRIPTION OF A PREFERRED EMBODIMENT OF THE INVENTION

Figure 1:
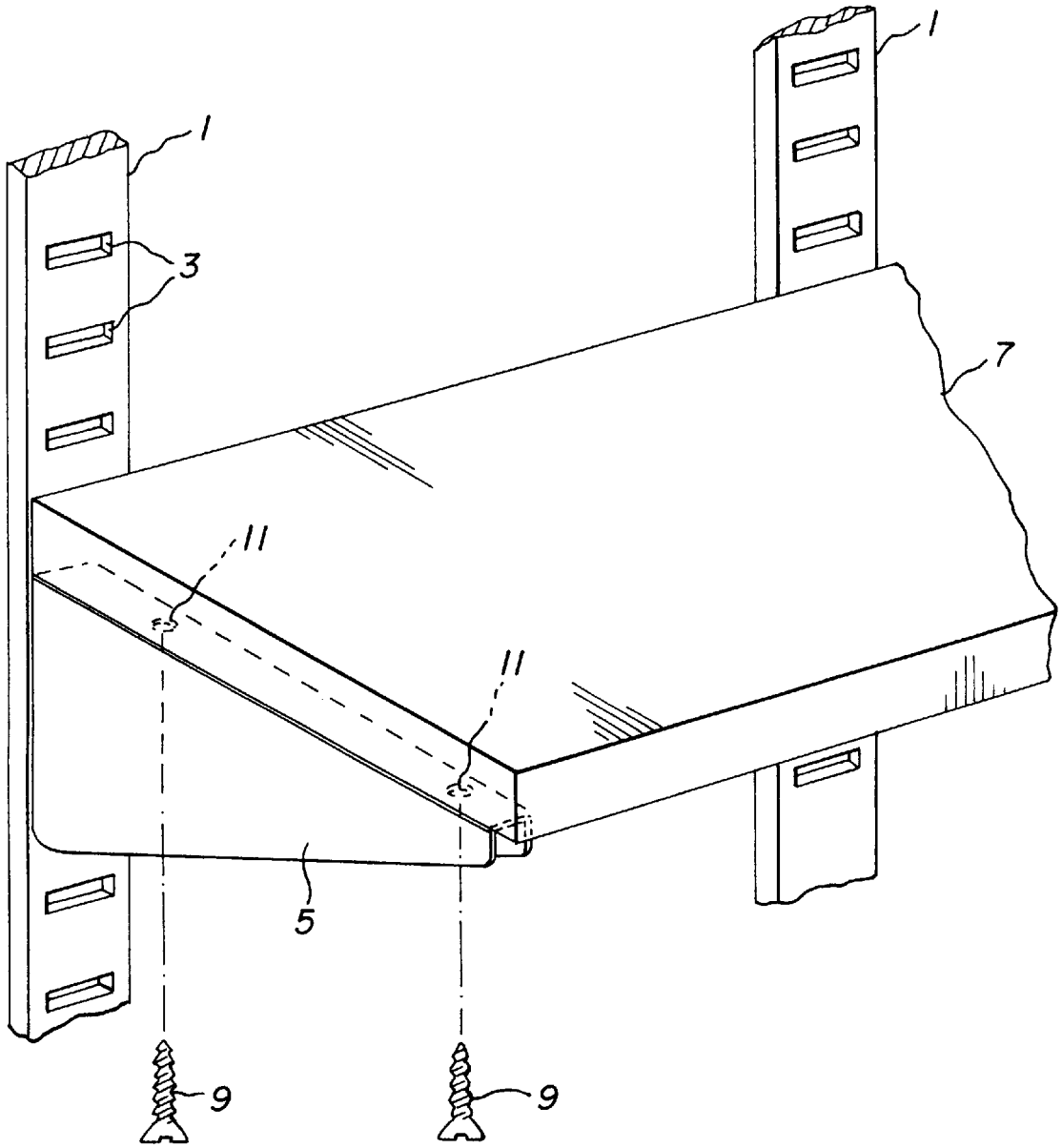
FIG. 1 PRIOR ART
FIG. 1 shows a shelving system according to the prior art.
Figure 2:
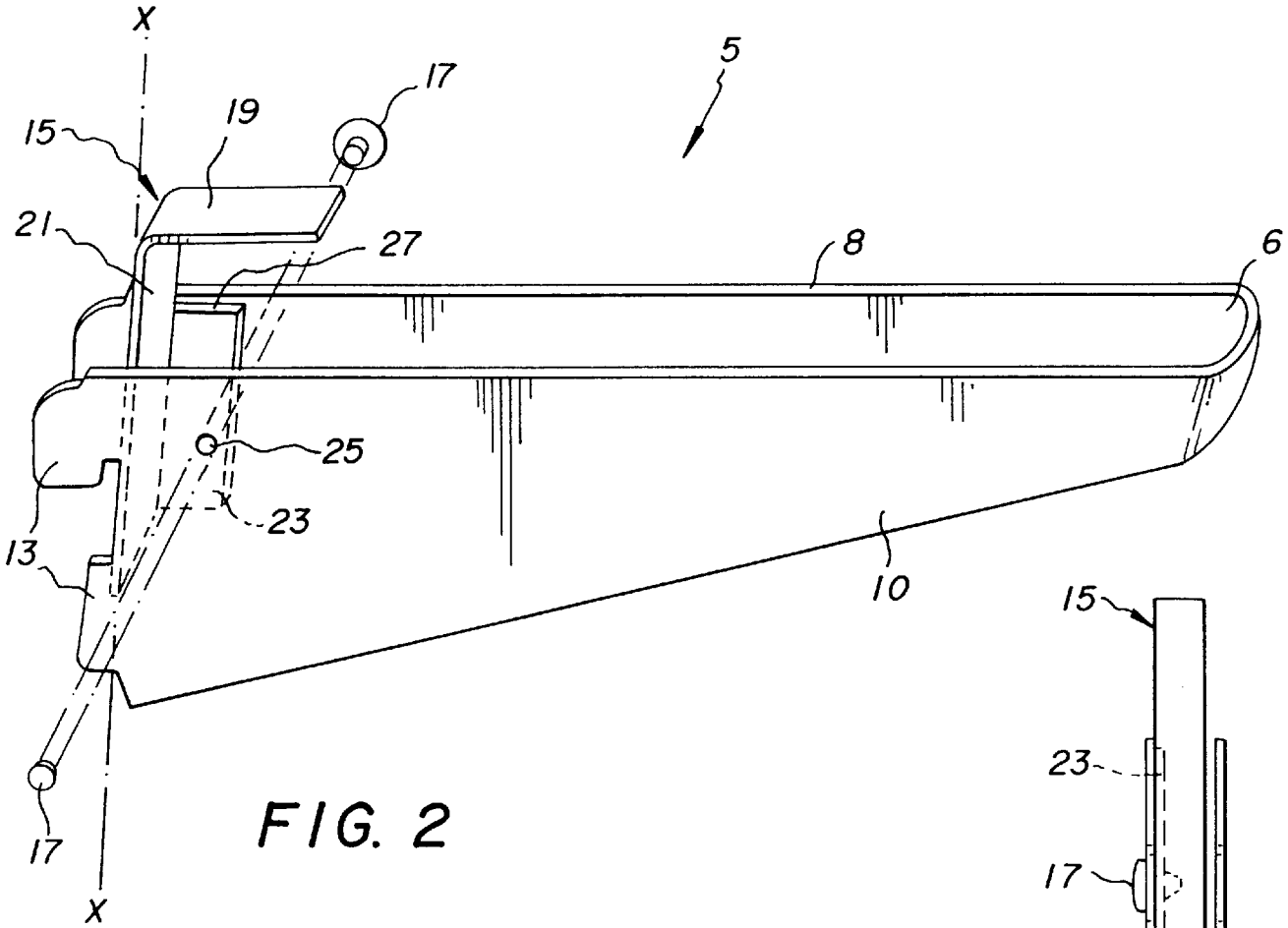
FIG. 2 shows a shelf support according to a preferred embodiment of the present invention.
Figure 4:
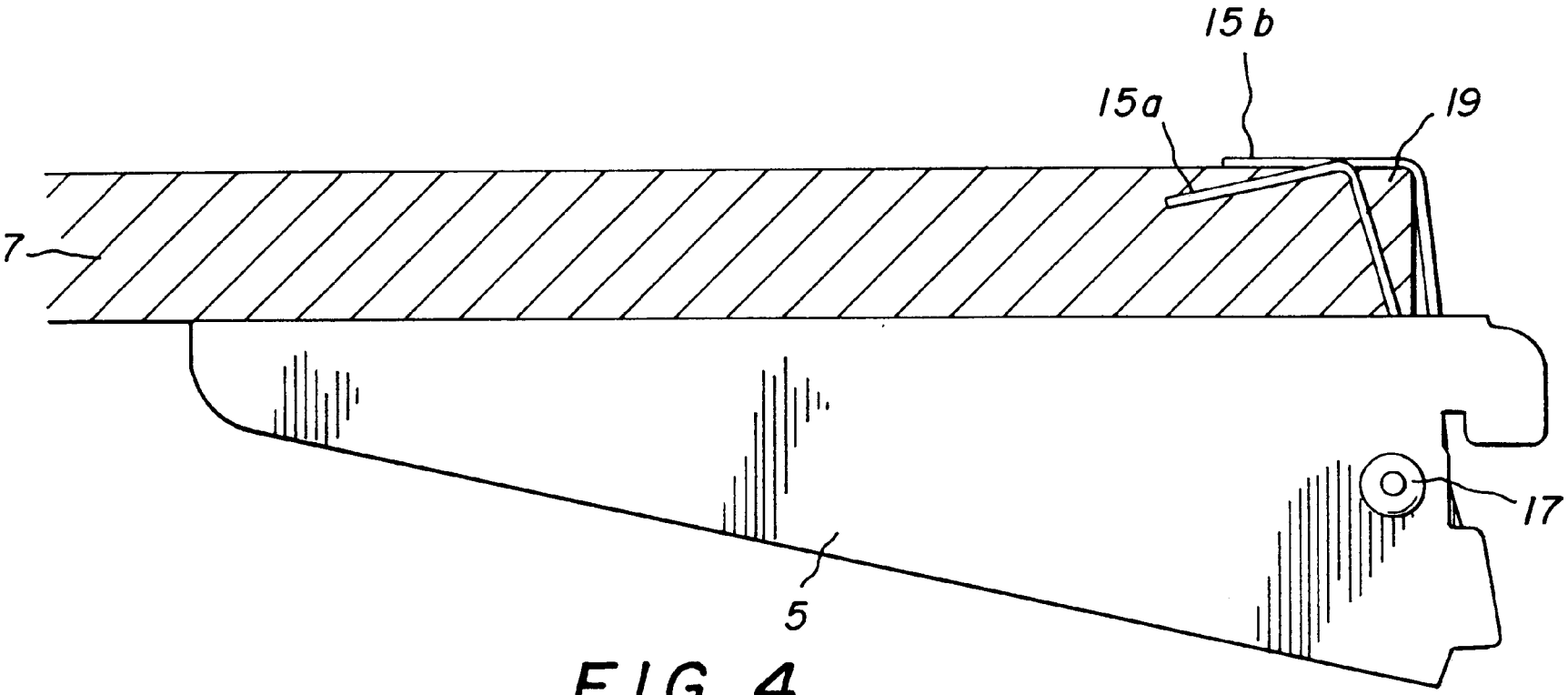
FIG. 4 shows the shelf support of FIG. 2 with a shelf in position.

The shelf support 5 shown in FIG. 2 comprises a support body 10, having a support surface 8 for supporting a shelf 7 (FIG. 4). The support body 10 has mounting means 13, which allow the shelf support 5 to be releasably connected to an upright component similar to the track 1 of FIG. 1, although with slots 3 shaped suitably for receiving the mounting means 13. The mounting means 13 comprises projections which extend from a mounting surface lying in the plane X—X on the support body 10 which, in use, abuts the track 1. Such an arrangement is known as "spur shelving". Of course, in order to support the shelf 7, a pair of shelf supports 5 are required. For simplicity, however, only one of these shelf supports 5 is illustrated in FIG. 2.

The shelf support 5 has a retaining element 15, which includes a carrier portion 21, a mounting flange 23 and an engaging portion 19. The retaining element 15 is pivotably connected to the support body 10 by a pivot pin 17, for example a rivet, which passes through the support body 10 and a hole 25 in the mounting flange 23. The axis of the pivotable connection passes through the support body at a position spaced below the support surface 8.

During assembly of the shelf support 5 to the upright track 1, the end 6 of the support body which is furthermost from the track 1 must be tilted upwards so that the mounting means 13 can engage with their respective slots 3. Since the retaining element 15 is pivotably connected to the support body 10, it is free to pivot when the shelf support 5 is being fitted in this manner, thereby preventing it from interfering with the assembly process. When pivoting, part of the carrier portion 21, which is furthermost from the engaging portion 19, projects away from the support body 10 beyond the mounting surface X—X.

As the shelf support 5 is lowered into its shelf supporting position, the above mentioned part of the carrier portion 21 meets the track 1, thereby causing the retaining element 15 to pivot into an engagement position. In the engagement position, the abutment of the carrier portion 21 against the track 1 provides a stop which prevents the retaining element 15 from pivoting further, thereby retaining it in the engagement position.

When in this position, the engaging portion 19 is parallel with the support surface 8, enabling a shelf which is placed on the support surface 8 to be retained in place. The distance between the engaging portion 19 and the support surface 8 is such that it allows a shelf to be fitted between the two said parts, yet is sufficiently tight so as to hold the shelf in place.

Figure 3:
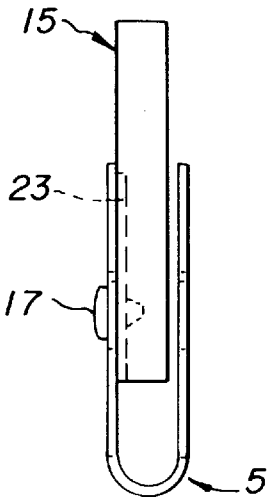
FIG. 3 shows the shelf support of FIG. 2 from an end elevation.

FIG. 3 shows the arrangement of FIG. 2 from an end elevation. It illustrates how the pivot pin 17 is used to connect the retaining element 15 to the support body 10 via its mounting flange 23. The pivot pin 17 provides the pivot about which the retaining element 15 rotates.

FIG. 4 shows the shelf support 5 having a shelf 7 fitted thereon. As mentioned above, while the shelf support 5 is being fitted to the upright track 1, (with the shelf removed), the retaining element 15 pivots to the first position as illustrated by 15*a*. After the shelf support 5 has been lowered to its shelf supporting position, the retaining element 15 is in its engagement position, as shown by 15*b*.

The invention described above enables a shelf to be held firmly in place on a shelf support, without the need for fixing screws, and without hindering the fitting and dismantling of the shelf supports themselves.

What is claimed is:

1. A shelf support comprising a support body having mounting means for mounting the support on an upright component, and having a support surface for supporting a shelf, the support having a retaining element which is pivotably connected to the support body at a position below the support surface and said retaining element being adapted for movement into and out of an engagement position in which, in use, the retaining element engages an upper surface of the shelf supported by the support surface, thereby to retain the shelf on the support surface.

2. A shelf support as claimed in claim 1, in which the retaining element is restrained from pivoting when the shelf support is engaged with the upright component.

3. A shelf support as claimed in claim 1, in which the mounting means extends from a mounting surface which, in use, engages the upright component.

4. A shelf support as claimed in claim 1, in which the retaining element has a carrier portion, which is pivotably connected to the support body, and an engaging portion which is carried by the carrier portion.

5. A shelf support as claimed in claim 4, in which the mounting means extends from a mounting surface which in use, engages the upright component and, in which movement of the carrier portion away from the engagement position causes a part of the carrier portion to project from the support body beyond the mounting surface, whereby, in use, the upright component provides a stop to retain the retaining element in the engagement position.

6. A shelf support as claimed in claim 4, in which the carrier portion extends across the plane of the support surface, the engaging portion being spaced from the support surface on the side of the support surface away from the support body.

7. A shelf support as claimed in claim 6, in which the engaging portion, when in the engagement position, is parallel to the plane of the support surface.

8. A shelf support as claimed in claim 4, wherein the carrier portion has a mounting flange provided with a hole receiving a pivot pin forming the pivotable connection.

9. A shelf support as claimed in claim 1, in which the axis of the pivotable connection passes through the support body at a position spaced away from the support surface.

10. A shelving structure including a shelf support as claimed in claim 1, and a shelf supported on the shelf support.

11. A shelving structure as claimed in claim 10, in which the retaining element has a carrier portion, which is pivotably connected to the support, and an engaging portion which is carried by the carrier portion and, in which an edge of the shelf abuts the carrier portion of the retaining element.

* * * * *